US005226843A

United States Patent [19]

Yun

[11] Patent Number: 5,226,843

[45] Date of Patent: Jul. 13, 1993

[54] AMPHIBIAN BICYCLE

[76] Inventor: Oi C. Yun, 390-2 Jangrim-2-Dong, Saha-Ku, Pusan, Rep. of Korea

[21] Appl. No.: 876,294

[22] Filed: Apr. 30, 1992

[30] Foreign Application Priority Data

Nov. 19, 1991 [KR] Rep. of Korea ..... 91-19996

[51] Int. Cl.[5] ..... B63H 21/175

[52] U.S. Cl. ..... 440/11; 440/90

[58] Field of Search ..... 440/26-31, 440/11, 90; 114/270

[56] References Cited

U.S. PATENT DOCUMENTS 2,757,631 8/1956 Truter ..... 114/270
3,640,239 2/1972 Petroskey ..... 440/90
4,559,892 12/1985 Cascallana ..... 440/30

*Primary Examiner*—Jesus D. Sotelo

[57] ABSTRACT

An amphibian bicycle including a bicycle body, two pairs of air tubes, air tube supporting members, a direction controller, a plurality of wheel webs, a front brake locking member, a rear brake pad lifting member, and a ratchet gearing stopper, whereby on water operations, the front brake locking member locks front wheel movements, and rear wheel movements are allowed by the rear brake pad lifting member and the ratchet gearing stopper. For the land operations, the air tubes, air tube supporting members, the direction controller, the wheel webs are separated from the amphibian bicycle, and the front brake locking member, the rear brake pad lifting member, and the ratchet gearing stopper are operated to allow front and rear wheel movements.

5 Claims, 4 Drawing Sheets

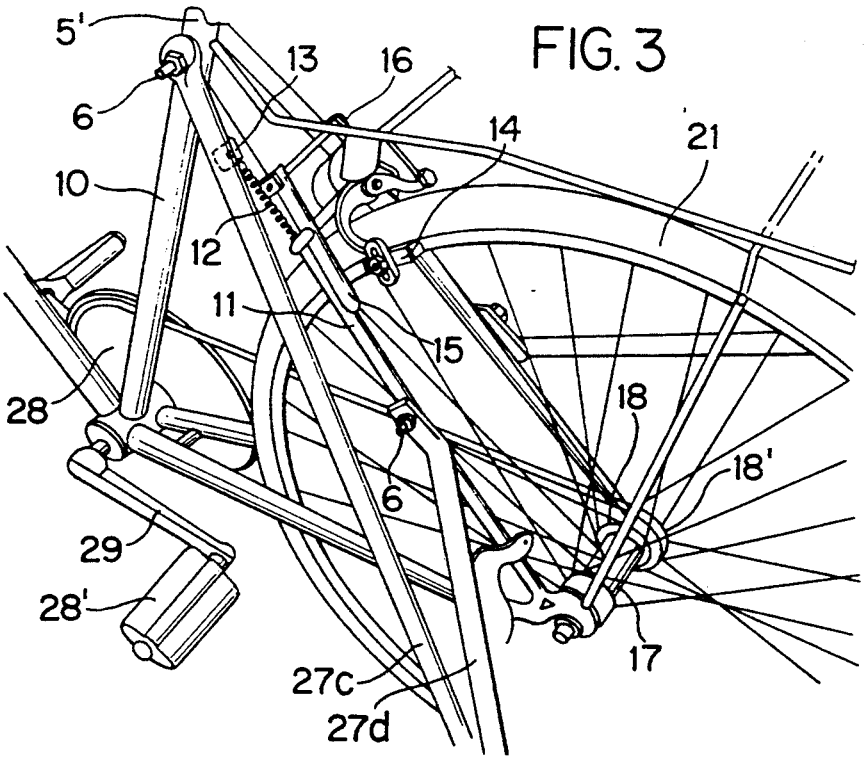
FIG. 3
FIG. 4
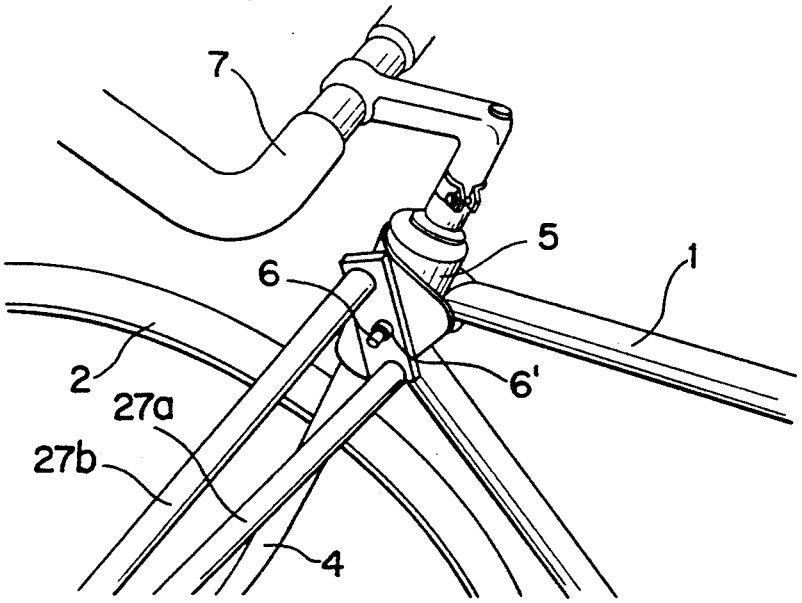

AMPHIBIAN BICYCLE

BACKGROUND OF THE INVENTION

1. Field of the Invention

The present invention relates to an amphibian bicycle adapted for both land and water, and more particularly, to a land and water bicycle which includes removable air tubes, wheel webs, an a direction controller whereby the bicycle can be used both as a bicycle on land and a boat on water.

2. Description of the Prior Art

Several types of water bicycles adapted for water are known in the art. However, such water bicycles cannot be used on land. Even though these water bicycles can be used on land, it is difficult to disassemble a number of parts so as to use them as a land bicycle.

SUMMARY OF THE INVENTION

Accordingly, it is an object of the present invention to provide an amphibian bicycle which eliminates the above problems encountered with the conventional amphibian bicycles.

Another object of the present invention is to provide a land and water bicycle which comprises a plurality of air tubes and wheel webs, and a direction controller which are easily separated from the water bicycle to be used as a land bicycle.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an amphibian bicycle including a bicycle body, two pairs of air tubes, air tube supporting members, a direction controller, a plurality of wheel webs, a front brake locking member, a rear brake pad lifting member, and a ratchet gearing stopper, whereby on water operations, the front brake locking member locks front wheel movements, and rear wheel movements are allowed by the rear brake pad lifting member and the ratchet gearing stopper. For the land operations, the air tubes, air tube supporting members, the direction controller, the wheel webs are separated from the amphibian bicycle, and the front brake locking member, the rear brake pad lifting member, and the ratchet gearing stopper are operated to allow front and rear wheel movements.

BRIEF DESCRIPTION OF THE DRAWINGS

The present invention will become more fully understood from the detailed description given hereinbelow and the accompany drawings which are given by way of illustration only, and thus are not limitative of the present invention, and wherein:

FIG. 3 is a perspective view of a rear wheel member of the amphibian bicycle according to the present invention;

FIG. 4 is a perspective view of an air tube supports attached to a tubular front joint according to the present invention;

DESCRIPTION OF THE PREFERRED EMBODIMENTS

Figure 1:
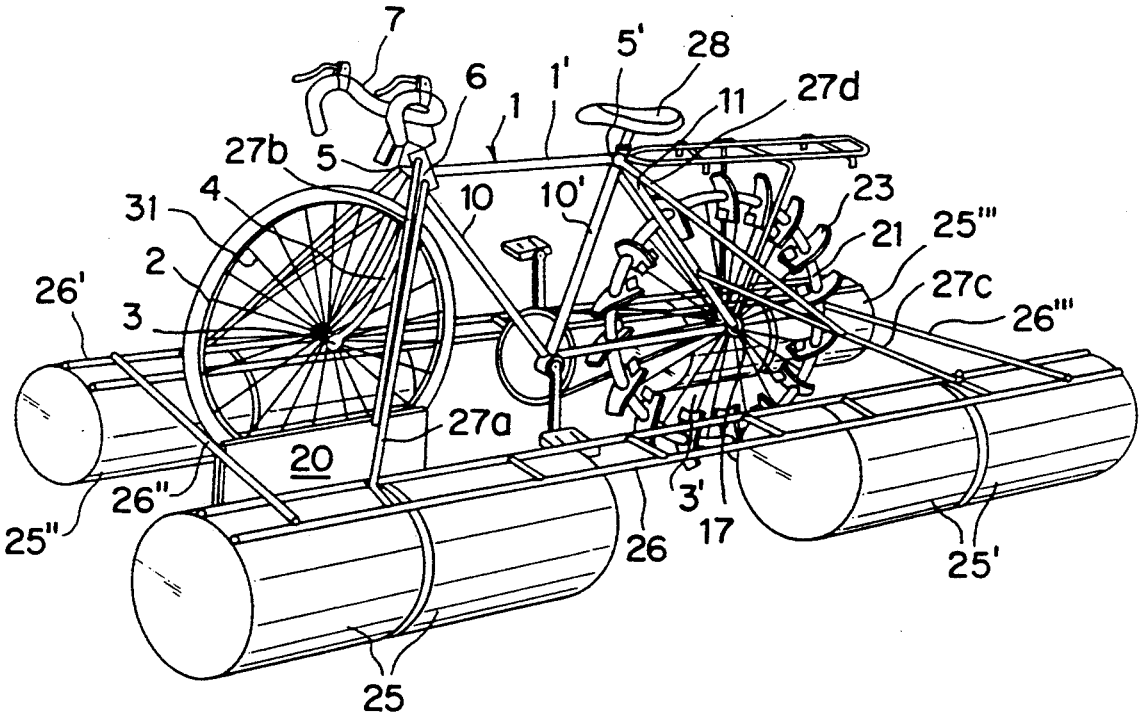
FIG. 1 is a perspective view of the amphibian bicycle according to the present invention.

Referring now in detail to the drawings for the purpose of illustrating preferred embodiments of the present invention, the amphibian bicycle adapted for both land and water as shown in FIGS. 1, 7, 8, 9, and 10, comprises a triangular frame 1, a front fork 4 connected to a tubular front joint 5, a rear fork 11 connected to a rear joint portion 5', a front wheel 2 rotatably supported by the front fork 4, and a rear wheel 21 supported by the rear fork 11.

The triangular frame 1 includes a top bar 1' and a bottom bar 10 jointed to an upright post 10'. The top bar 1' is provided with the rear joint portion 5' for securing the rear fork 11 thereto. A seat 28 is mounted on the top of the upright post 10'. The front and rear wheels 2 and 21 have a front hub 3 and a rear hub 17, and a plurality of spokes 3'. The rear hub 17 of the rear wheel 21 is provided with a wheel sprocket 18 which is connected to the bottom joint portion of the triangular frame 1 for accommodating a wheel chain 18'. The wheel chain 18' is located over a pedal sprocket 28 rotatably mounted on the bottom of the upright post 10' (FIG. 3).

Figure 5:
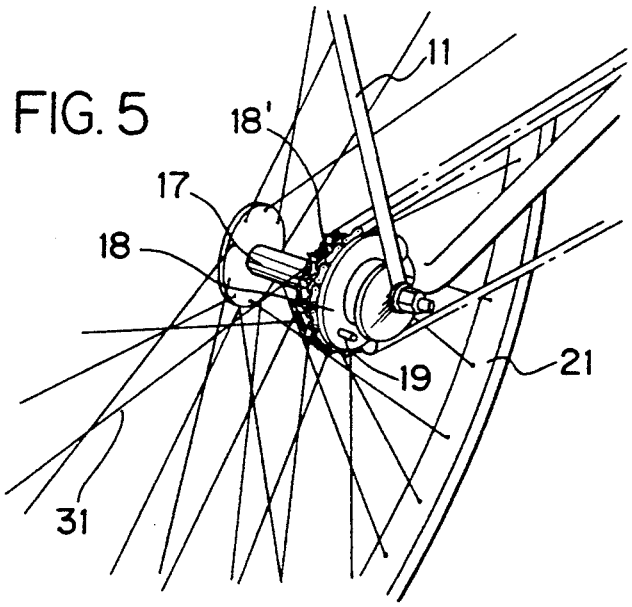
FIG. 5 is a perspective view of a chain gear of the rear wheel member according to the present invention.

As shown in FIG. 5, the wheel sprocket 18 has a ratchet gearing stopper 19 disposed thereon, thereby the bicycle can be moved backward on water by reversely rotating the pedals 28'. the conventional bicycle generally has a ratchet gearing to prevent from reversely rotating the pedals any backward movements.

The pedal sprocket 28 is connected to a pair of foot pedals 28' through a pair of pedal supports 29 which are operable by foot power to rotate the pedal sprocket 28 and thereby rotate the rear wheel 21 to propel the bicycle over the roadway or water. The rear fork 11 is provided with a pair of fixed plates 13 attached thereto, a pair of brake pads 14 connected to a pair of fixed brackets 16 through brake supports 15, and a pair of springs 12 connected to both brake supports 15 and fixed plates 13 (FIG. 3).

Accordingly, to use the bicycle of the present invention on water, the brake supports 15 should be lifted up. At this time, the brake supports 15 with brake pads 14 stay over the rear wheel 21 due to a force exerted by the springs 12. Therefore, the rear wheel containing wheel webs 23 can rotate freely. In turn, the bicycle of the present invention is adapted for land use. The brake supports 15 with brake pads 14 is pushed down which returns the pair of brake pads 14 in the vicinity of the rear wheel 21 for land breaking.

Figure 2:
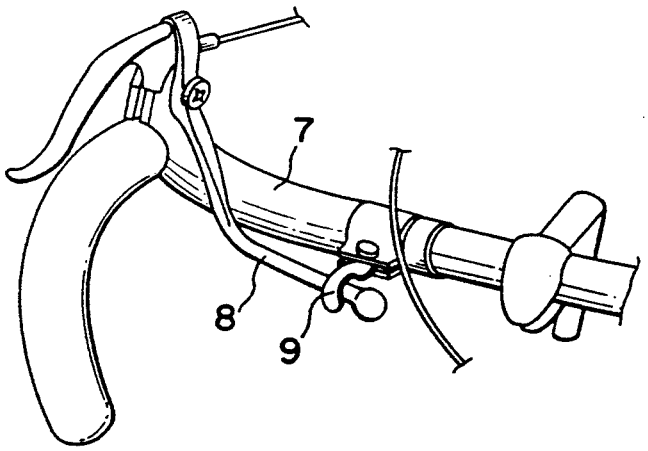
FIG. 2 is a perspective view of a handle member of the amphibian bicycle according to the present invention.

A suitable electric motor or internal combustion engine can be used to drive the rear wheel 21. As shown in FIG. 4, the tubular front joint portion 5 of the front fork 4 extends and is pivotably connected to a handle bar 7. The handle bar 7 is provided with a front brake lever 8 and a lever locking member 9 (FIG. 2).

Figure 8:
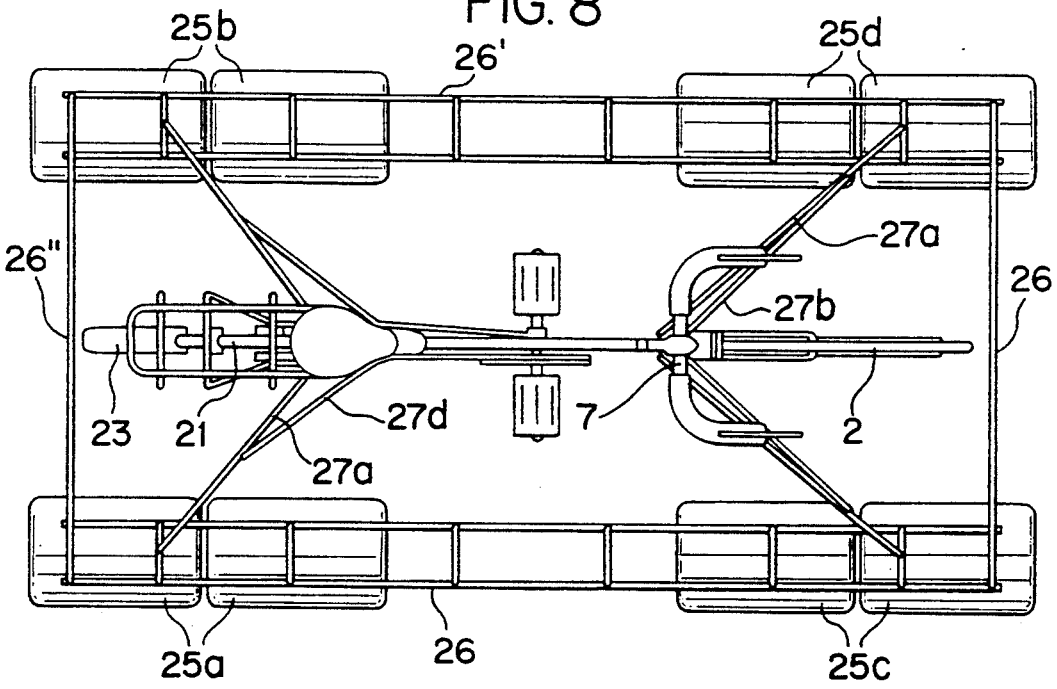
FIG. 8 is a top plane view of the amphibian bicycle according to the present invention.
Figure 10:
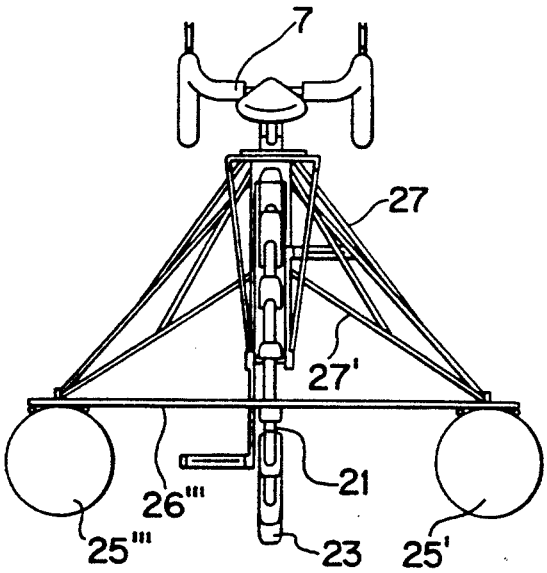
FIG. 10 is a right side elevational view of the amphibian bicycle according to the present invention.

As shown in FIGS. 4, 8, and 10, the tubular front joint 5 is provided with a pair of bolt supports 6 fixed thereto for connecting with a pair of front air tube main supports 27*a* and a front auxiliary supports 27*b* by bolts 6'. Two pair of bolt supports 6 fixed to the upper portion of the bottom bar 10 and on the middle portion of the rear fork 11 allow a rear air tube main support 27*c* and a rear air tube auxiliary support 27*d*. A pair of front air tubes 25*a* and 26*b* and a pair of rear air tubes 25*c* and 25*d* supported by a rectangular pipe frame at four corners are attached to the ends of front and rear air supports 27*a*, 27*b*, 27*c*, and 27*d* by bolts for riding on (FIG. 8). Thus, the bicycle of the present invention has the pair of right side air tubes 25 and 25*d*, and the pair of left side air tubes 25*a* and 25*c* disposed on both sides of the bicycle so that even though one of the air tubes is flat, the bicycle of the present invention is still operational on water.

Figure 6:
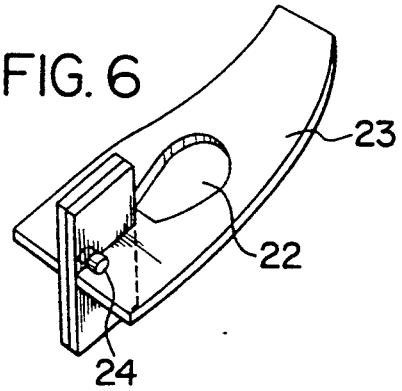
FIG. 6 is a perspective view of a wheel web of the rear wheel member according to the present invention.
Figure 7:
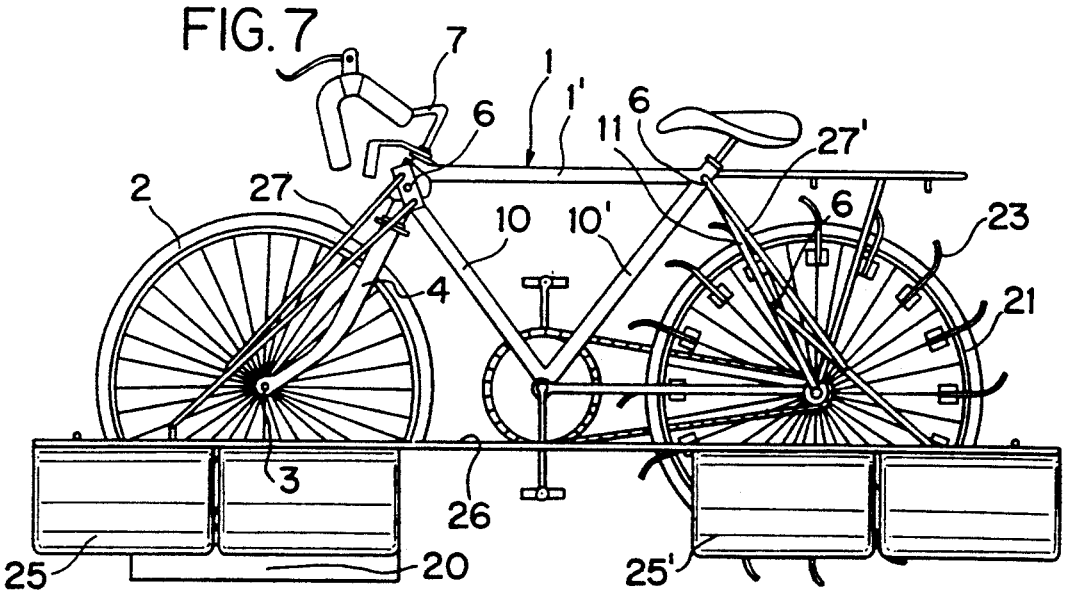
FIG. 7 is a front elevational view of the amphibian bicycle according to the present invention.
Figure 9:
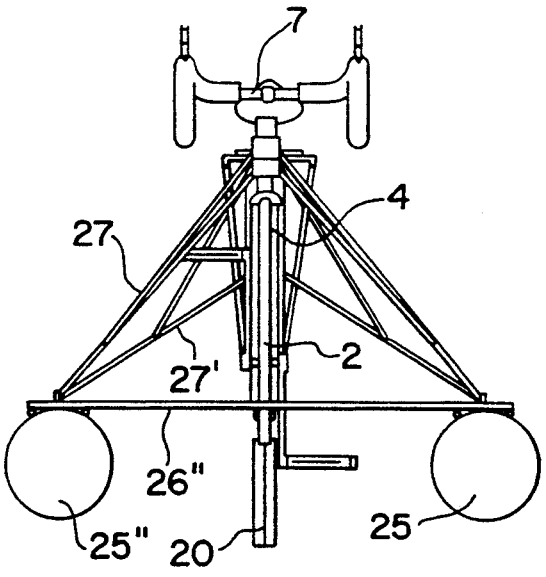
FIG. 9 is a left side elevational view of the amphibian bicycle according to the present invention.

A direction controller 20 is rotatably attached to the lower portion of the front wheel 2 by bolts (FIGS. 1 and 9). As shown in FIGS. 1, 6 and 7, a plurality of wheel webs 23 contain an opening 22 for receiving the rear wheel 21 and a hook 24 for locking onto the rear wheel 21. The rotation of the locked wheel webs 23 generates force which allows forward or backward movements depending on the pedalling direction.

As the above described, when the bicycle of the present invention operates on water, the four air tubes 25*a*, 25*b*, 25*c*, 25*d* as well as the air tube main supports 27*a* and the air tube auxiliary supports 27*b*, the plurality of water webs 23, the direction controller 20, the brake supports 15 with the fixed brackets 16 and the fixed plates 13, the ratchet gearing stopper 19, and the front brake lever locking member 9 are used.

However, when the bicycle of the present invention operates on land, the four air tubes 25*a*, 26*b*, 25*c*, and 25*d*, the eight tube supports 27*a* and 27*b*, the plurality of wheel 23, and the direction controller 20 should be detached from the bicycle by removing bolts 6'. The brake supports 14 should return to its original position and the front brake lever 8 should be released so as to provide front and rear brake operations. In addition, the ratchet gearing stopper 19 should be released for operating the ratchet gearing (not shown).

Accordingly, the bicycle of the present invention is operational on water or land. This amphibian bicycle is easily assembled with or disassembled from the conventional land bicycle using separate parts.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An amphibian bicycle, comprising:

a regular bicycle having a basic frame, front and rear forks front and rear wheels, a handle bar, a tubular front joint, a front brake lever, rear brake pads, and a ratchet gearing, two pair of air tubes connected to a rectangular pipe frame, air tube supporting members attached to said tubular front joint and said basic frame and rear fork, a direction controller attached to said front wheel, a plurality of wheel webs attached to said rear wheel for generating force which allows forward or backward movements, a front brake lever locking member disposed on said handle bar for selectively locking said front brake lever, a rear brake pad lifting member connected to said rear brake pads in the vicinity of said rear wheel, a ratchet gearing stopper operatively connected to said ratchet gearing, whereby upon operating on water, the front brake locking member locks front wheel movements, and rear wheel movements are allowed by the rear brake pad lifting member and the ratchet gearing stopper, and in turn, upon operating on land, the two pairs of air tubes, the air tube supporting members, the direction controller and the wheel webs are separated from the amphibian bicycle and the front brake lever and the rear brake pad lifting member are operable.

2. The amphibian bicycle of claim 1, wherein said air tube supporting members define a pair of front air tube main supports attached to bolt supports extended from said tubular front joint and a pair of front air tube auxiliary supports attached to said bolt supports, and the air tube supporting members further define a pair of rear air tube main supports attached to bolt supports extended from a rear joint portion of said basic frame and a pair of rear auxiliary supports attached to the middle portions of said rear forks.

3. The amphibian bicycle of claim 1, wherein said rear brake pad lifting member includes a pair of fixed plates mounted on the upper portion of the rear fork, a pair of fixed brackets, a pair of springs connected to the fixed plates at one end thereof, and a pair of brake supports connected to said fixed plates, said springs, and said rear brake pads.

4. The amphibian bicycle of claim 1 wherein, each of said plurality of wheel webs includes an opening for slidably receiving the rear wheel and a fork member for securing it to the rear wheel.

5. The amphibian bicycle of claim 1 wherein, said air tube supporting members and direction controllers connect to said bolt supports and said front wheel by bolts.

* * * * *